US009077101B2

(12) United States Patent
Wu et al.

(10) Patent No.: US 9,077,101 B2
(45) Date of Patent: Jul. 7, 2015

(54) CABLE ASSEMBLY

(71) Applicant: Hon Hai Precision Industry Co., Ltd., New Taipei (TW)

(72) Inventors: Jerry Wu, Irvine, CA (US); Jun Chen, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 210 days.

(21) Appl. No.: 13/848,704

(22) Filed: Mar. 21, 2013

(65) Prior Publication Data

US 2013/0252471 A1 Sep. 26, 2013

(30) Foreign Application Priority Data

Mar. 21, 2012 (CN) ..... 2012 1 0075952

(51) Int. Cl.
*H01R 3/00* (2006.01)
*H01R 12/53* (2011.01)
*H01R 13/6474* (2011.01)

(52) U.S. Cl.
CPC ..... *H01R 12/53* (2013.01); *H01R 13/6474* (2013.01)

(58) Field of Classification Search
CPC .. H01R 13/658; H01R 13/6658; H01R 13/58; H01R 4/023; H01R 4/2429; H01R 9/2416; H01R 12/79; H01R 12/592; H01R 13/506; H05K 1/118
USPC ..... 439/499, 492, 494, 942
See application file for complete search history.

(56) References Cited

U.S. PATENT DOCUMENTS

| | | | | |
|---|---|---|---|---|
| 3,573,719 | A * | 4/1971 | Lightner | 439/494 |
| 4,605,276 | A * | 8/1986 | Hasircoglu | 439/465 |
| 5,201,662 | A | 4/1993 | Roche | |
| 5,411,421 | A * | 5/1995 | McCardell, Jr. | 439/879 |
| 6,007,362 | A * | 12/1999 | Davis et al. | 439/358 |
| 6,007,385 | A * | 12/1999 | Wu | 439/607.45 |
| 6,129,594 | A * | 10/2000 | Lai | 439/701 |
| 6,171,139 | B1 | 1/2001 | Sato et al. | |
| 6,585,528 | B1 * | 7/2003 | Lin et al. | 439/76.1 |
| 6,729,901 | B2 * | 5/2004 | Aekins | 439/418 |
| 6,739,904 | B2 * | 5/2004 | Wu | 439/497 |

(Continued)

FOREIGN PATENT DOCUMENTS

| | | | |
|---|---|---|---|
| CN | 2599810 | Y | 1/2004 |
| CN | 2711949 | Y | 7/2005 |

(Continued)

*Primary Examiner* — Abdullah Riyami
*Assistant Examiner* — Vladimir Imas
(74) *Attorney, Agent, or Firm* — Wei Te Chung; Ming Chieh Chang

(57) ABSTRACT

A cable assembly comprises an insulative housing, a plurality of terminals disposed in the insulative housing; printed circuit board assembled to a rear end of the insulative housing and electrically connected to the plurality of terminals; a wire management assembled to a rear end of the printed circuit board and defining a curved top surface. The wire management defines a plurality of spaced slots formed on the curved top surface, arranged along a transversal direction and extending along a longitudinal direction. And, a cable comprises a plurality of conductive wires respectively passing through the plurality of slots and electrically connected to the rear end of the printed circuit board. The lengths of the plurality of slots are gradually decreased from higher section of the curved top surface to lower section of the curved top surface.

20 Claims, 7 Drawing Sheets

(56) References Cited

U.S. PATENT DOCUMENTS

| | | | | |
|---|---|---|---|---|
| 6,802,744 | B2 * | 10/2004 | Chiang | 439/701 |
| 6,869,308 | B2 * | 3/2005 | Wu | 439/497 |
| 7,018,241 | B2 * | 3/2006 | Caveney et al. | 439/676 |
| 7,090,534 | B2 * | 8/2006 | Wu et al. | 439/607.41 |
| 7,147,512 | B2 * | 12/2006 | Wu | 439/607.05 |
| 7,351,117 | B1 * | 4/2008 | Mostoller et al. | 439/744 |
| 7,462,063 | B1 * | 12/2008 | Correll | 439/460 |
| 7,497,724 | B1 * | 3/2009 | Fong et al. | 439/497 |
| 7,632,155 | B1 * | 12/2009 | Wu | 439/660 |
| 7,699,646 | B2 * | 4/2010 | Zhu et al. | 439/493 |
| 7,758,374 | B2 * | 7/2010 | Yu et al. | 439/493 |
| 8,070,525 | B2 * | 12/2011 | Hou et al. | 439/660 |
| 8,100,729 | B2 * | 1/2012 | Chen et al. | 439/719 |
| 8,172,620 | B2 * | 5/2012 | Su et al. | 439/660 |
| 8,262,035 | B2 * | 9/2012 | Bleus et al. | 248/68.1 |
| 8,500,494 | B2 * | 8/2013 | Wu | 439/660 |
| 8,702,453 | B2 * | 4/2014 | Caveney et al. | 439/676 |
| 8,858,254 | B2 * | 10/2014 | Ikari et al. | 439/492 |
| 2006/0148319 | A1 * | 7/2006 | Huang | 439/607 |
| 2011/0070778 | A1 * | 3/2011 | Wan et al. | 439/660 |

FOREIGN PATENT DOCUMENTS

| | | | |
|---|---|---|---|
| CN | 2749097 | Y | 12/2005 |
| CN | 200959402 | Y | 10/2007 |
| CN | 201336396 | Y | 10/2009 |
| CN | 202564568 | U | 11/2012 |
| DE | 10301278 | A1 | 7/2004 |

* cited by examiner

CABLE ASSEMBLY

FIELD OF THE INVENTION

The present invention generally relates to a cable assembly, more specifically to a cable assembly with high signal transmitting rate.

DESCRIPTION OF PRIOR ART

China Pat. No. 2711949Y issued to Yang on Jul. 20, 2005 discloses a cable assembly comprising an insulative housing, a metallic shell shielding the insulative housing, a plurality of terminals arranged into two rows and received into the insulative housing, a printed circuit board soldered to the terminals, a wire management assembled to a rear end of the printed circuit board and a round cable having a plurality of conductive wires arranged by the wire management and soldered to the rear end of the printed circuit board. The wire management comprises a first half of wire management and a second half of wire management stacked and positioned with each other. The first and second half of wire management respectively defines a plurality of slots for receiving conductive wires of a round cable. The printed circuit board defines a plurality of rear conductive pads formed on top and bottom surfaces of the rear end of the printed circuit board. The plurality of conductive wires are arranged into two rows and respectively soldered to the corresponding conductive pads. It should be noted that front ends of the conductive wires are arranged by the wire management. However, other portions of conductive wires exposed out of a jacket of the round cable are loosely except that of two lateral conductive wires. So, when a rearward pulling force exerts on the round cable, only two lateral conductive wires of the round cable are firstly deserved by the pulling force. As a result, two lateral conductive wires may be easily discreted from the printed circuit board after several pulling times. Thus, the signal transmitting of the cable assembly will be interrupted.

According to the above problem, center conductive wires of the round cable are designed to be shorter than lateral conductive wires. Thus, all conductive wires of the round cable are tightly fixed to the printed circuit board. However, a new problem is raised up. When the plurality of conductive wires are respectively soldered to the plurality of rear conductive pads of the printed circuit board, the length of lateral conductive wires electrical connected to the two lateral conductive pads are longer than the length of center conductive wires electrical connected to the center conductive pads. Thus, a total length of terminal and the conductive wire is different from another total length of the terminal and the conductive wire. As a result, signal delay phenomenon is happened between two groups of terminal and conductive wire. The signal receiving time of the different terminals are different with each other when the cable assembly is in a working state. If a gap of length between two groups of the terminal and corresponding conductive wire is big, a gap of receiving time between two terminals are also become longer. So, a signal transmitting quality of the cable assembly is not good.

An improved cable assembly overcoming shortages of existing technology is needed.

SUMMARY OF THE INVENTION

Accordingly, an object of the present invention is to provide a cable assembly with improved signal transmitting performance.

In order to achieve the above-mentioned object, a cable assembly comprises: an insulative housing; a plurality of terminals disposed in the insulative housing; a printed circuit board assembled to a rear end of the insulative housing and electrically connected to the plurality of terminals; a wire management assembled to a rear end of the printed circuit board and defining a curved top surface, the wire management defining a plurality of spaced slots formed on the curved top surface, the plurality of slots arranged along a transversal direction and extending along a longitudinal direction; and a cable comprising a plurality of conductive wires respectively passing through the plurality of slots and electrically connected to the rear end of the printed circuit board; wherein lengths of the plurality of slots are gradually decreased from higher section of the curved top surface to lower section of the curved top surface.

Other objects, features and advantages of the invention will be apparent from the following detailed description taken in connection with the accompanying drawings.

DETAILED DESCRIPTION OF PREFERRED EMBODIMENTS

Figure 1:
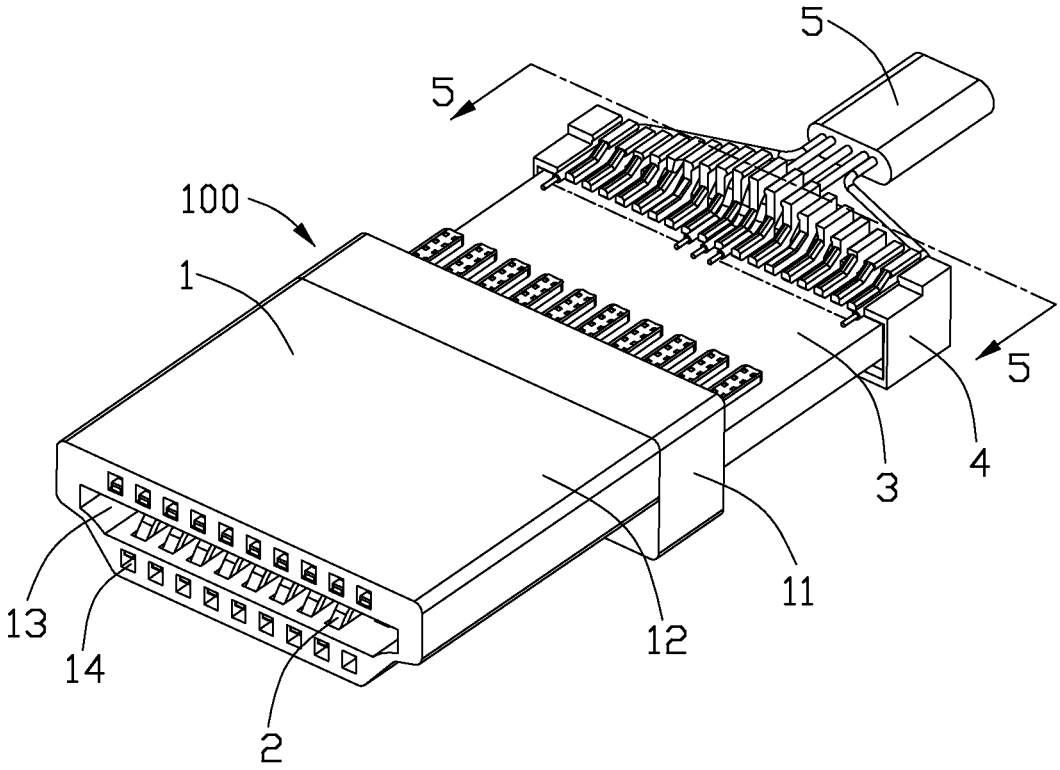
FIG. 1 is a perspective view of a cable assembly in accordance with the present invention.

Reference will now be made to the drawing figures to describe the present invention in detail.

Figure 2:
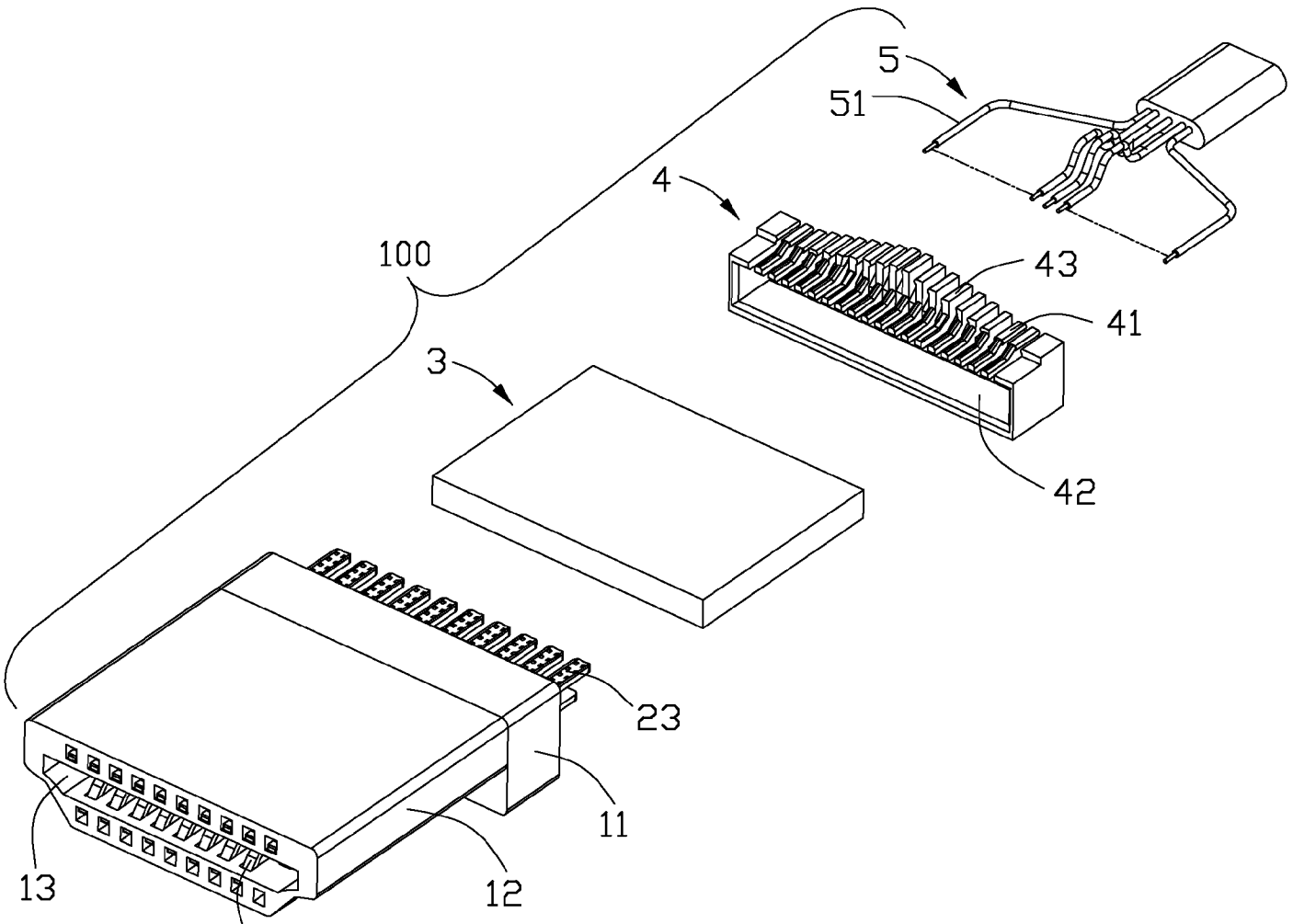
FIG. 2 is an exploded, perspective view of FIG. 1.

FIG. 1 illustrate perspective view of a cable assembly 100 made in accordance with the present invention. Referring to FIG. 2, the cable assembly 100 comprises an insulative housing 1, a plurality of terminals 2 disposed in the insulative housing 1, a printed circuit board 3 assembled to a rear end of the housing 1 and electrically connected to the plurality of terminals 2, a cable 5 having a plurality of conductive wires 51 electrically connected to a rear end of the printed circuit board 3 and a wire management 4 assembled to the rear end of the printed circuit board 3.

Referring to FIGS. 1 to 2, the insulative housing 1 is generally structured in a D shape. The insulative housing 1 defines a body portion 11 and a mating portion 12 extending forwardly from the body portion 11. The insulative housing 1 defines a receiving room 13 extending rearwardly from a front surface of the mating portion 12, and two rows of receiving passages 14 extending throughout front and rear surfaces of the insulative housing 1 and communitcated with the receiving room 13. Two rows of receiving passages 14 are respectively formed on top and bottom inner surfaces of the receiving room 13.

Figure 7:
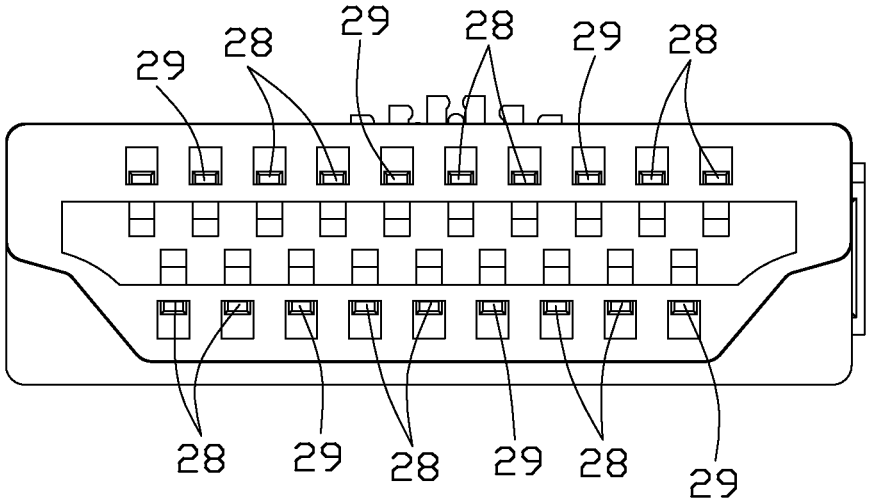
FIG. 7 is a front view of the cable assembly of FIG. 1.

Referring to FIGS. 1,2 and in conjunction with FIG. 7, the plurality of terminals 2 are respectively received into the corresponding receiving passages 14 of the insulative housing 1. Each of terminal 2 defines a front mating section 21, a rear soldering section 23 and a connecting section (not shown in FIGS.) for retaining itself in the insulative housing 1. The soldering sections 23 of the plurality of terminals 2 are extending rearwardly and located out of the insulative housing 1.

Referring to FIG. 7, the plurality of terminals 2 are divided into two rows and comprises several terminal groups. Each of the terminal group comprises a pair of differential signal terminals 28 located on a row of terminals 2 and a grounding terminal 29 located on another row of the terminals 2. The pair of differential signal terminals 28 and the grounding terminal 29 are structured in a triangle shape viewed from a front surface of the insulative housing 1. In this embodiment, the plurality of terminals 2 comprises six terminal groups.

Figure 3:
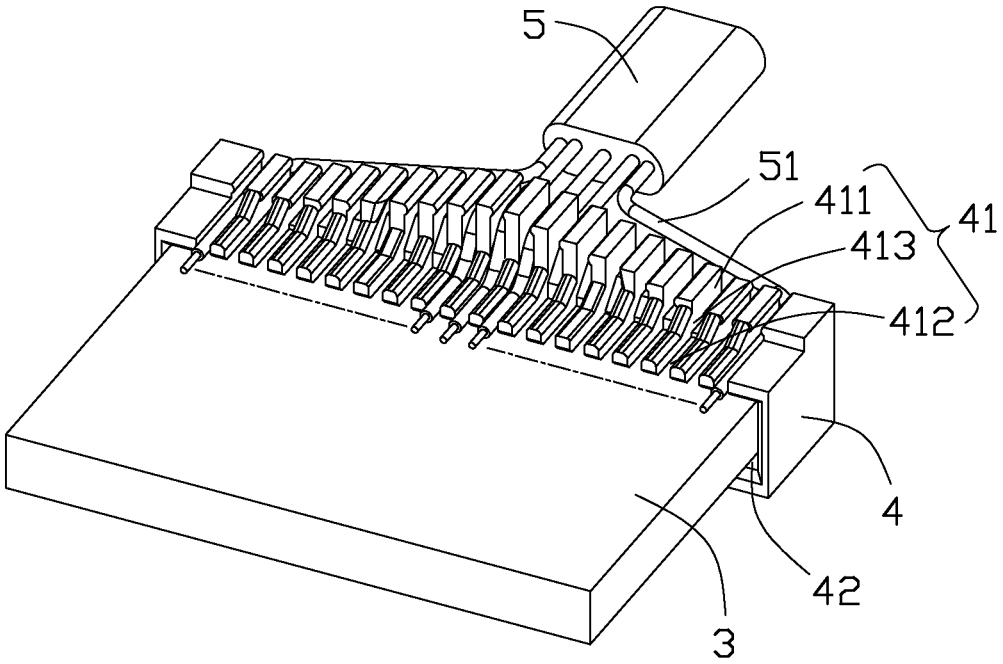
FIG. 3 is a partially assembled view of the cable assembly of FIG. 2.
Figure 4:
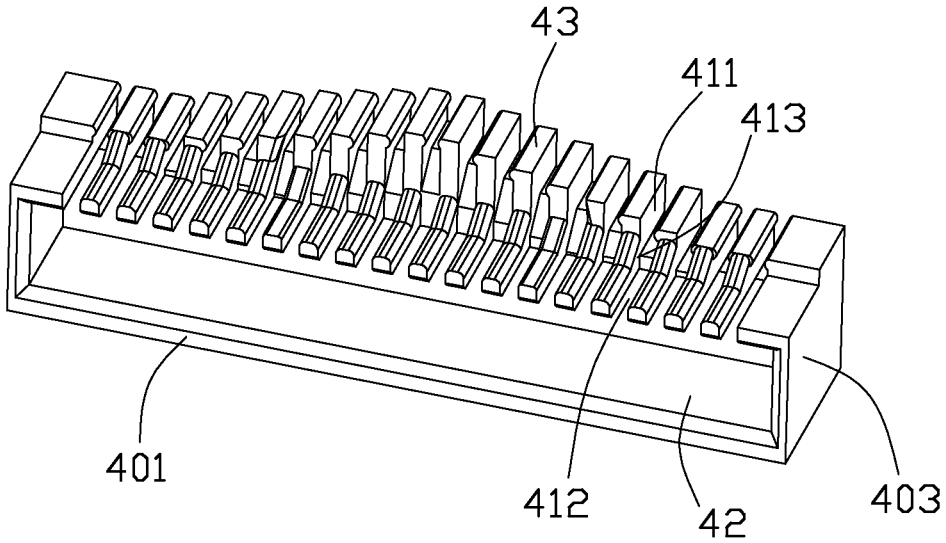
FIG. 4 is an enlarged and perspective view of a wire management of cable assembly of FIG. 2.
Figure 5:
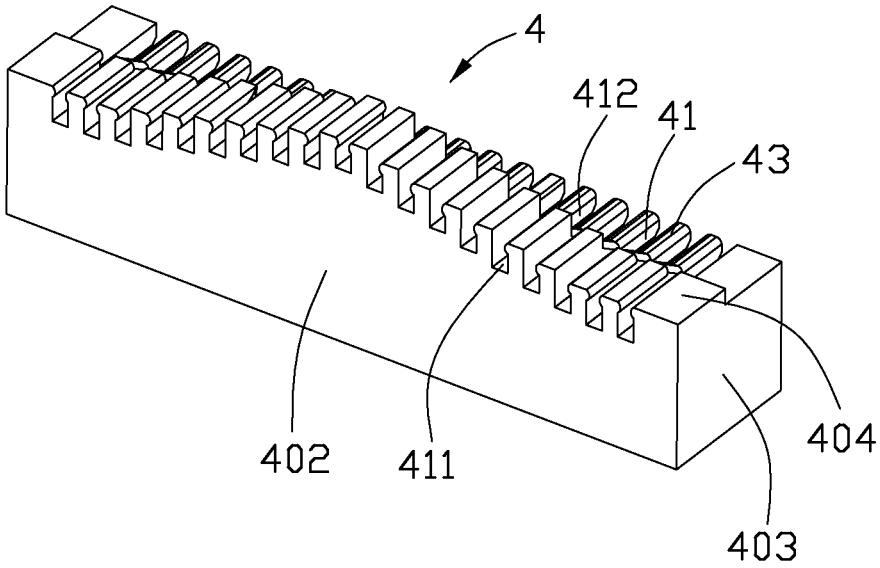
FIG. 5 is another perspective view of FIG. 4.
Figure 6:
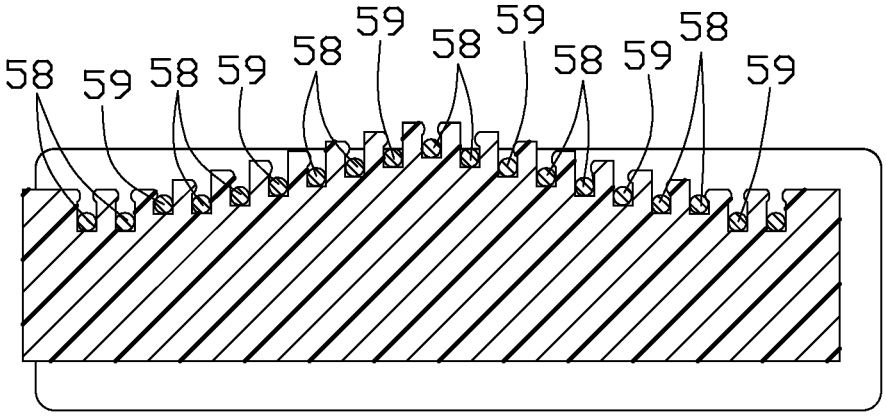
FIG. 6 is a cross section view of the cable assembly of FIG. 1 taken along line 5-5.

Referring to FIGS. 1 to 3, the cable 5 comprises a plurality of conductive wires 51 formed therein. The plurality of conductive wires 51 comprises several pairs of signal wires 58 and grounding wires 59 electrically connected to a top surface of a rear end of the printed circuit board 3.

Referring to FIGS. 2 to 5, the wire management 4 defines a front surface 401, a rear surface 402 opposite to the front surface 401, two lateral surfaces 403 and a top surface 404. The wire management 4 defines a plurality of slots 41 arranged along a transversal direction and spaced apart with each. The plurality of slots 41 are formed on the top surface 404 of the wire management 4 and extending along a front to rear direction for retaining conductive wires 51. The top surface 404 is structured in a circular arc shape. The center section of the top surface 404 is higher than two side sections of the top surface 404. Obviously, the plurality of slots 41 formed on a center section of the top surface 404 are located on a higher plane than the plurality of slots 41 formed on two lateral sections of the top surface 404. Each of slot 41 comprises a rear horizontal section 411, and a front horizontal section 412 and a middle inclined section 413. The front horizontal sections 412 of the slots 41 are all located below the rear horizontal sections 411 of the slots 41. It should be noted that the front horizontal sections 412 of the all slots 41 are located on a same plane, and the rear horizontal sections 411 are mostly located on different planes. And, the height of the slots 41 of the wire management 4 are gradually decreased from center portion to two lateral portions of the wire management 4. And, the gap between two bottom surfaces of the front and rear horizontal sections 412, 411 of the slots 4 are gradually increased from two lateral portions to center portion of the wire management 4. Obviously, the lengths of the slots 41 are gradually decreased from the center portion to the two lateral portions of the wire management 4. The wire management 4 defines a receiving cavity 43 for receiving a rear end of the printed circuit board 3.

Referring to FIGS. 1 to 7, the assembling process of the cable assembly 100 made in according to the present invention starts from assembling the plurality of terminals 2 to the insulative housing 1. Then, a printed circuit board 3 is assembled to a rear end of the insulative housing 1 and soldered to the plurality of terminals 2. Then, the wire management 4 is assembled to the printed circuit board 3. The rear end of the printed circuit board 3 is received into the receiving cavity 43 of the wire management 4. Then, the plurality of conductive wires 51 are respectively passed through the slots 41 and positioned by the wire management 4. Several conductive wires 51 of the plurality conductive wires 51 are raised in a higher position by the wire management 4 than other conductive wires 51 of the plurality of conductive wires 51. At last, the plurality of conductive wires 51 are soldered to the rear end of the printed circuit board 3. After the above assembling steps, the entire process of assembling of the cable assembly 100 is finished.

Generally, the cable 5 is located in a middle section of the wire management 4. And, the wire management 4 is wider than the cable 5. Thus, some conductive wires 51 need a long distance to extend into the lateral slots 41 of the wire management 4. And, some conductive wires 41 need a short distance to extend into the center slots 41 of the wire management 4. As the lengths of the slots 41 located on the center portion are larger than the lengths of the slots 41 located on the two lateral portions, so some conductive wires 51 extended into the slots 41 located on a center portion of wire management 4 are not loose and well positioned in the slots 41. When a pulling force is exerted on the cable 5, the plurality of conductive wires 51 are all deserved by the pulling force. Thus, two lateral conductive wires 51 will not be easily discrete from the printed circuit board 3. At this moment, the signal transmitting of the cable assembly is working well. On another aspect, the all conductive wires 51 have equal length. Thus, signal delay phenomenon of the cable assembly 100 will not be happened. And the signal transmitting performance of the cable assembly 100 is also improved. In addition, the conductive wires 51 of the cable 5 can be soldered to the rear end of printed circuit board 3 through one soldering time. Thus, the assembling process of the cable assembly 100 is also simple and easily.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly comprising:

an insulative housing;

a plurality of terminals disposed in the insulative housing;

a printed circuit board assembled to a rear end of the insulative housing and electrically connected to the plurality of terminals;

a wire management assembled to a rear end of the printed circuit board and defining a curved top surface, the wire management defining a plurality of spaced slots formed on the curved top surface, the plurality of slots arranged along a transversal direction and extending along a longitudinal direction; and a cable comprising a plurality of conductive wires respectively passing through the plurality of slots and electrically connected to the rear end of the printed circuit board;

wherein lengths of the plurality of slots are gradually decreased from a higher section of the curved top surface to a lower section of the curved top surface.

2. The cable assembly as recited in claim 1, wherein each of the slot defines a rear horizontal section and a front horizontal section located below the rear horizontal section.

3. The cable assembly as recited in claim 2, wherein the front horizontal sections of the plurality of slots are located on a same plane.

4. The cable assembly as recited in claim 3, wherein heights of the rear horizontal sections of the plurality of slots are gradually decreased from higher section of the curved top surface to lower section of the curved top surface.

5. The cable assembly as recited in claim 4, wherein gap between two bottom surfaces of the front and rear horizontal sections of the slots are gradually increased from lower section of the curved top surface to the higher section of the curved top surface.

6. The cable assembly as recited in claim 1, wherein the wire management defines a receiving cavity receiving the rear end of the printed circuit board.

7. The cable assembly as recited in claim 1, wherein the plurality of conductive wires are electrically connected to a top surface of the printed circuit board.

8. The cable assembly as recited in claim 1, wherein the plurality of conductive wires comprises several pairs of signal wires and several grounding wires, two adjacent pairs of signal wires are intervened by a grounding wire.

9. The cable assembly as claimed in claim 1, wherein the plurality of terminals are arranged into two rows and comprises several terminal group, each of terminal group comprises a pair of differential signal terminals and a grounding terminal located on different rows.

10. The cable assembly as claimed in claim 1, wherein the higher section of the curved top surface is located on a middle section of the curved top surface, the lower section of the curved top surface is located on two lateral sections of the curved top surface.

11. A cable assembly comprising:

an insulative housing defining a plurality of receiving passages formed therein;

a plurality of terminals received into the corresponding receiving passages of the insulative housing;

a printed circuit board electrically connected to rear ends of the plurality of terminals;

a wire management attached to the printed circuit board, and defining a plurality of spaced slots formed on a curved top surface thereof and arranged along a transversal direction; and a cable comprising a plurality of conductive wires electrically connected to the rear end of the printed circuit board, the plurality of conductive wires arranged along a transversal direction and respectively extending into the plurality of slots and;

wherein several conductive wires of the plurality conductive wires are raised in a higher position by the wire management than other conductive wires of the plurality of conductive wires;

wherein lengths of the plurality of slots are gradually decreased from a higher section of the curved top surface to a lower section of the curved top surface.

12. The cable assembly as recited in claim 11, wherein the wire management defines a receiving cavity, the rear end of the printed circuit board is received into the receiving cavity.

13. The cable assembly as recited in claim 11, wherein a plurality of front sections of the plurality of slots are located on a same plane.

14. A cable assembly comprising:

an insulative housing defining a front mating port and a rear mounting port in a front-to-back direction;

a row of contacts disposed in the housing in a transverse direction perpendicular to said front-to-back direction, each of said contacts extending in said front-to-back direction with a front contacting section exposed in the mating port and a rear connecting section in the mounting port; and a cable enclosing a plurality of wires in a confined manner, said wires defining corresponding respective front connection sections spreading divergently to have corresponding connection ends located along said transverse direction to compliantly electrically connect to the corresponding contacts, respectively; wherein the front connection sections located around a middle position in said transverse direction extend in a vertical direction perpendicular to both said front-to-back direction and said transverse direction, more than those located around two opposite lateral side positions in said transverse direction so that said front connection sections of all said wires are able to keep a similar length for reduce skews which are originally generated due to divergent spreading of the front connection sections if no extension difference in the vertical direction among the front connection sections of said wires.

15. The cable assembly as claimed in claim 14, further including a wire management defining corresponding slots at different heights in said vertical direction into which the front connection sections are located.

16. The cable assembly as claimed in claim 15, wherein a printed circuit board is provided between the rear connecting sections of the contacts and the front connection sections of the wires in said front-to-back direction.

17. The cable assembly as claimed in claim 16, wherein the wire management is overlapped with the printed circuit board in the vertical direction.

18. The cable assembly as claimed in claim 15, wherein each of said slots extends in precisely the front-to-back direction.

19. The cable assembly as claimed in claim 18, wherein depths of said slots are same.

20. The cable assembly as claimed in claim 15, wherein said slots are commonly formed under a curved top surface of the wire management, and a higher section is located around a center area of said curved top surface while two opposite lower sections are located on two opposite lateral sides of said curved surface, and lengths of the plurality of slots are gradually decreased from the higher section to the lower section.

* * * * *